US006662475B2

(12) United States Patent
Lewia

(10) Patent No.: US 6,662,475 B2
(45) Date of Patent: Dec. 16, 2003

(54) REVERSIBLE HEEL

(75) Inventor: Charles H. Lewia, Skowhegan, ME (US)

(73) Assignee: Columbia Insurance Company, Omaha, NE (US)

( * ) Notice: Subject to any disclaimer, the term of this patent is extended or adjusted under 35 U.S.C. 154(b) by 61 days.

(21) Appl. No.: 10/086,015

(22) Filed: Feb. 27, 2002

(65) Prior Publication Data

US 2003/0159314 A1 Aug. 28, 2003

(51) Int. Cl.[7] ..... A43B 5/00; A43B 21/36
(52) U.S. Cl. ..... 36/130; 36/42; 36/36 R
(58) Field of Search ..... 36/130, 15, 100, 36/114, 72 B, 42, 36 R

(56) References Cited

U.S. PATENT DOCUMENTS

| | | | | |
|---|---|---|---|---|
| D48,042 | S | | 10/1915 | Phillips |
| D59,807 | S | | 11/1921 | Altruda |
| 1,395,958 | A | | 11/1921 | Hamilton |
| 1,464,365 | A | | 8/1923 | Koetter |
| 1,580,475 | A | | 4/1926 | Farnan |
| 2,300,091 | A | | 10/1942 | Barry |
| 2,640,283 | A | | 6/1953 | McCord |
| 3,011,272 | A | | 12/1961 | Goldenberg |
| 3,027,661 | A | | 4/1962 | McCord |
| 3,041,746 | A | | 7/1962 | Rakus |
| 3,063,169 | A | | 11/1962 | Cortina |
| 3,068,592 | A | | 12/1962 | Antelo |
| 3,074,184 | A | | 1/1963 | Litak |
| 3,195,244 | A | | 7/1965 | Whitcas |
| 3,318,025 | A | | 5/1967 | Antelo |
| 3,478,447 | A | | 11/1969 | Gillead |
| 3,526,976 | A | | 9/1970 | Jacobs |
| 3,538,626 | A | | 11/1970 | Einstein, Jr. |
| 3,672,077 | A | | 6/1972 | Coles |
| 4,214,384 | A | | 7/1980 | Gonzalez |
| 4,351,120 | A | | 9/1982 | Dalebout |
| 4,377,042 | A | | 3/1983 | Bauer |
| 4,445,285 | A | | 5/1984 | Phillips |
| 4,551,930 | A | | 11/1985 | Graham et al. |
| 4,716,664 | A | | 1/1988 | Taylor |
| D326,954 | S | | 6/1992 | Kiyosawa et al. |
| 5,542,198 | A | | 8/1996 | Famolare |
| 5,560,126 | A | * | 10/1996 | Meschan et al. ..... 36/42 |
| 5,615,497 | A | * | 4/1997 | Meschan ..... 36/15 |
| 5,826,352 | A | * | 10/1998 | Meschan et al. ..... 36/42 |
| 5,970,628 | A | * | 10/1999 | Meschan ..... 36/42 |
| 6,389,712 | B1 | * | 5/2002 | Schelling ..... 36/15 |

FOREIGN PATENT DOCUMENTS

| | | |
|---|---|---|
| EP | 510 384 | 10/1992 |
| GB | 19561 | of 1891 |
| GB | 23401 | of 1906 |
| GB | 302111 | 12/1928 |
| GB | 2 159 038 | 11/1985 |

OTHER PUBLICATIONS

"Self–Adhering Nylon Tapes" Maurice Gersham, MD; Oct. 18, 1959; Journal of AMA; vol. 168, No. 7.
www.absbowling.co.jp (Feb. 28, 2000).

* cited by examiner

*Primary Examiner*—Anthony D. Stashick
(74) *Attorney, Agent, or Firm*—St. Onge Steward Johnston & Reens LLC

(57) ABSTRACT

A heel includes a member with a first surface having a fastening layer for removable attachment of the member to an outsole in two different positions, and a second surface having an outer layer with a first sliding characteristic in one position and a different sliding characteristic in another position. The removable heel provides bowlers with the flexibility to have one pair of shoes featuring different sliding characteristics to satisfy their needs in different lane surface conditions.

17 Claims, 2 Drawing Sheets

REVERSIBLE HEEL

TECHNICAL FIELD

This invention relates to footwear.

BACKGROUND

The outsoles of shoes are formed of different materials and different surfaces to provide varying amounts of shoe resistance and abrasion depending on the specific characteristics of the floor surface. In specific floor conditions, for instance, such as in a bowling lane, the stopping and sliding characteristics of the shoe can greatly enhance the ability of the bowler to stop his feet suddenly and abruptly.

SUMMARY

In a general aspect of the invention, a heel includes a member having a first surface with a fastening layer that allows for removable attachment of the heel to an outsole in a first and a second position. The member also includes a second surface that has an outer layer with a first sliding characteristic in the first position and a second sliding characteristic in the second position.

In embodiments of the invention, one or more of the following features may also be included.

In certain embodiments, the member includes a first rounded end and a second rounded end both corresponding to a shape of a heel section of the outsole.

As yet another feature, the outer layer of the member has a number of wedges defining a series of apexes separated by a series of nadirs.

Further, the wedges are in an angled configuration sloping toward a rear section of the heel in the first position and the wedges are in an angled configuration sloping toward a foot section of the heel in the second position. The first position of provides less stopping ability than the second position.

As another feature, the first position is rotated 180 degrees from the second position relative to the outsole.

Moreover, the fastening layer includes interlocking hook and pile fastener materials for attaching the fastening layer to the outsole.

As another feature, the outer layer includes molded rubber material, and the material forming the apexes is different than a material forming the nadirs.

According to another aspect of the invention, a method of changing a sliding characteristic of a shoe includes removing a heel member from an outsole of the shoe, the member having a fastening layer for removable attachment to an outsole in a first position having a first sliding characteristic provided in an outer layer. The method further includes changing the member from a first orientation to a second orientation, and reattaching the member to the outsole in a second position having a second sliding characteristic.

In embodiments of the invention, one or more of the following features may also be included. The first orientation includes a configuration of the first position and the second orientation includes a configuration of the second position.

In certain embodiments, the method also includes providing two rounded ends in the heel member where both ends correspond to a shape of a heel section of the outsole.

As another feature, the method includes providing the outer layer with wedges defining a series of apexes separated by a series of nadirs. The wedges include both an angled configuration sloping toward a rear section of the heel in the first position and an angled configuration sloping toward a foot section of the heel in the second position.

As another feature, the first position provides less stopping ability than the second position.

As yet another feature, the method also includes rotating the first position 180 degrees from the second position relative to the outsole. Additionally, the method includes providing the fastening layer with interlocking hook and pile fastener materials for attaching the fastening layer to the outsole.

As yet another feature, the outer layer includes molded rubber material. In addition, the sliding characteristic includes friction.

In certain embodiments, the method provides a different material to form the apexes and the nadirs.

Embodiments may have one or more of the following advantages. The reversible heel described above can provide the user with varying degrees of friction against the surface floor. The heel can provide users, especially bowlers who require maximum control and security in slippery surfaces, the ability to adjust their stopping ability in an abrupt manner.

Another advantage is the readily interchangeable nature of the reversible heel. Users may use the same heel to obtain what is essentially a different heel providing different friction or sliding characteristics.

In addition, another advantage of the reversible footwear is the enhanced comfort provided by the cushioning and resilience of the rubber layer of the reversible heel, which provides support and enhance the abrupt stopping ability of the user while in high-speed motion. Moreover, even with prolonged daily wear, the heel is less prone to deformation, wear, and tear.

Therefore, the removable heel provides bowlers with the flexibility to have one pair of shoes featuring different sliding characteristics to satisfy their needs in different lane surface conditions.

The details of one or more embodiments of the invention are set forth in the accompanying drawings and the description below. Other features, objects, and advantages of the invention will be apparent from the description and drawings, and from the claims.

DETAILED DESCRIPTION

Referring now to the figures in which identical elements are numbered identically throughout, a description of the embodiments of the present invention will now be provided.

Figure 1:
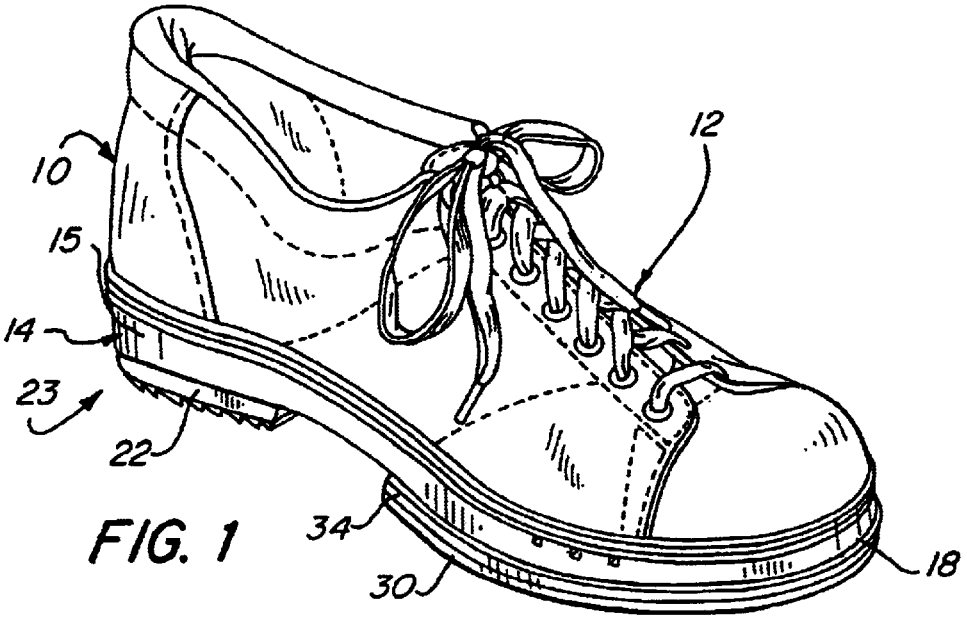
FIG. 1 is a perspective view of a bowling shoe.
Figure 2:
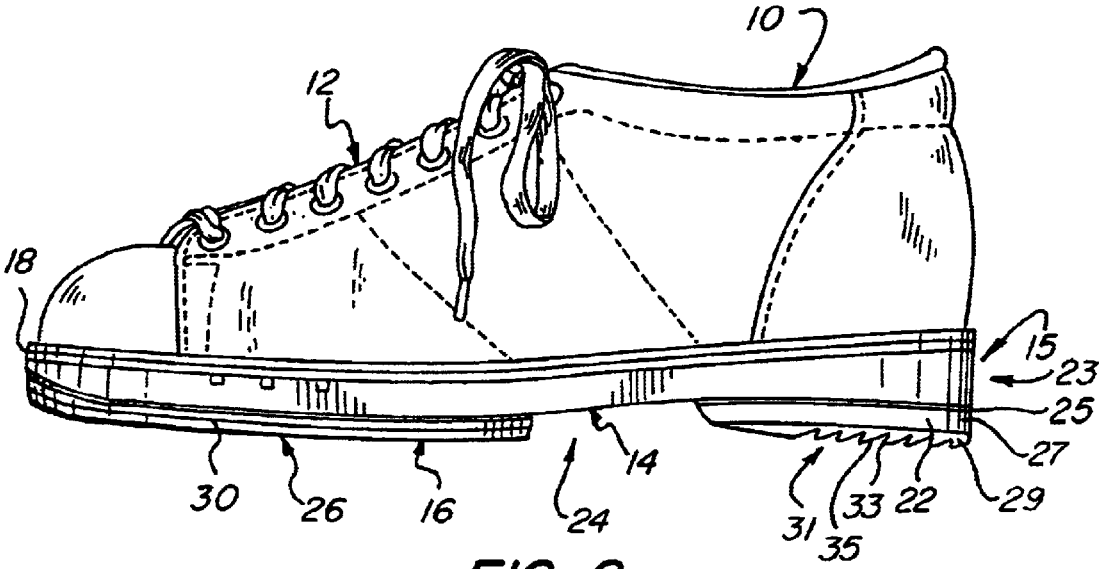
FIG. 2 is a side view of the bowling shoe of FIG. 1.

Referring to FIGS. 1 and 2, a bowling shoe 10 includes an upper 12 and a sole 14. The shoe upper 12 is constructed, for example, from leather materials. The shoe sole 14 is constructed from rubber, although other conventional shoe sole materials are also suitable. The sole 14 includes a toe end 18, a heel 22, and a downwardly facing tread surface 24. The sole 14 also includes a heel arch 15.

Figure 3:
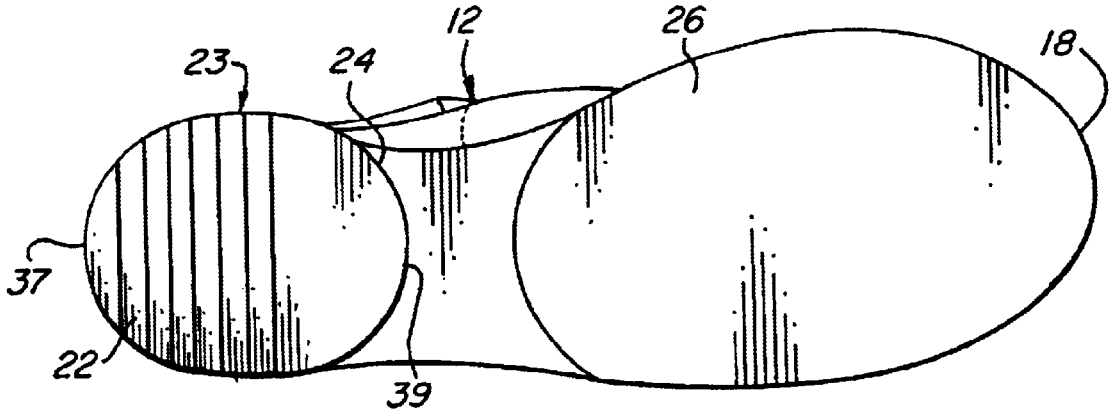
FIG. 3 is a bottom view of the bowling shoe of FIG. 1.

Referring to FIG. 3, the tread surface 24 includes a slide area 26 adjacent the toe end 18 of the sole 14. More specifically, the slide area 26 extends longitudinally from the toe end 18 rearwardly to the heel arch 15, and laterally across the entire width of the tread surface 24. Accordingly, it can be seen that the slide area 26 covers the entire tread surface 24 adjacent to the toe end 18 of the sole 14.

Referring to FIGS. 1 and 2, a slide pad 16 is provided in the slide area 26 and a heel 22 is provided in a heel region 23. The heel 22 includes a fastening sheet 25, a middle layer 27, and a wedge layer 29.

The slide pad 16 includes a thick sheet of flexible "slide material" 30 having a predetermined friction characteristic. In this connection, different types of "slide materials," such as leather and the like, which have varied friction characteristics, can be used. The slide pad 16 preferably has a substantially identical peripheral margin as the slide area 26 so that pad 16 covers the entire slide area 26.

The fastening sheet 25 removably secures the heel 22 to the outsole 14 by means of hook and pile fastener materials which are attached to the tread surface 24 and the slide material 30. The hook material is preferably attached to the entire slide area 26 of the tread surface 24, and the pile material is preferably attached to the slide material 30. Attachment of the hook and pile materials to their respective surfaces is accomplished using adhesives.

The middle layer 27 and the wedge layer 29 are fabricated with molded rubber material. The wedge layer 29 includes a number of wedges 31 with apexes 33 separated by nadirs 35.

Referring to FIG. 3, the heel 22 has a circular shape with a rear arch end 37 and an opposite arch end 39, both corresponding to the shape of the heel arch 15 (FIG. 2) of the sole 14. Therefore, the heel 22 may be positioned in the sole 14 in varying configurations, namely, rotated 180 degrees.

Figure 4A:
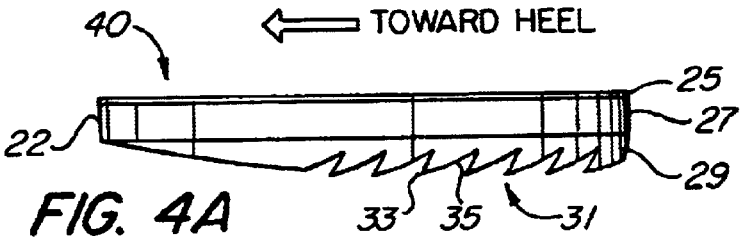
FIG. 4A is an exploded side view of a reversible heel.
Figure 4B:
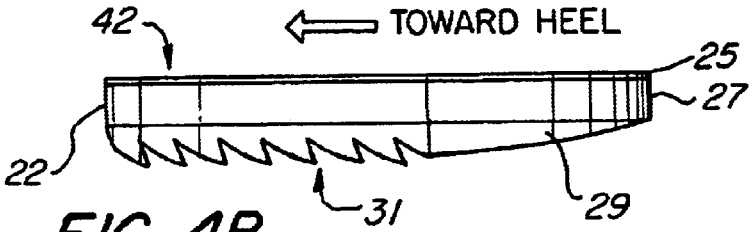
FIG. 4B is another exploded side view of the reversible heel.

Referring to FIGS. 4A and 4B, the heel 22 is illustrated in two different configurations. In FIG. 4A, the heel 22 is positioned in a configuration 40 where the wedges 31 slope toward the heel region 23 of the heel 22 whereas in FIG. 4B, the heel 22 has a configuration 42 where the wedges 31 slope toward the toe end 18 of the heel 22. In the configuration 40, the wedges 31 provide less stopping ability, i.e., less friction against a surface floor of a bowling lane, for instance. On the other hand, in the configuration 42, the wedges 31 provide more stopping ability and friction against the surface floor.

In use, the heel 22 is aligned over the heel region of the sole 14 and the fastening sheet 25 firmly pressed against the sole 14 to secure the fastening sheet 25 in position. The wearer may choose either configuration 40 or 42 depending on the desired level of friction against the surface of the bowling lane. For example, to vary the friction characteristics of the bowling shoe 10, the user simply removes the heel 22, turns it 180 degrees to another configuration and presses the heel 22 against the sole 14, thereby providing the bowling shoe 10 with a different friction or sliding characteristic in the heel 22.

Although the example described above provides that the middle layer 27 and the wedge layer 29 are made from the same type of material, different material may be used to form the various layers of the heel 22. In particular, the material forming the apexes 33 may be different than the material forming the nadirs 35, for example.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A heel comprising:

a member including:

a first surface having a fastening layer for removable attachment to an outsole in a first and a second position;

a second surface having an outer layer that includes a first sliding characteristic in the first position and a second sliding characteristic in the second position against a floor surface;

wherein the outer layer has a plurality of wedges defining a series of apexes separated by a series of nadirs; and wherein a material forming the apexes is different than a material forming the nadirs.

2. The heel of claim 1 wherein the member includes a first rounded end and a second rounded end both corresponding to a shape of a heel section of the out-sole.

3. The heel of claim 1 wherein the first position provides less stopping ability than the second position.

4. The heel of claim 3 wherein the plurality of wedges are in an angled configuration sloping toward a rear section of the heel in the first position and the plurality of wedges are in an angled configuration sloping toward a foot section of the heel in the second position.

5. The heel of claim 4 wherein the first position is rotated 180 degrees from the second position relative to the outsole.

6. The heel of claim 1 wherein the fastening layer includes interlocking hook and pile fastener materials for attaching the fastening layer to the outsole.

7. The heel of claim 1 wherein the outer layer comprises molded rubber material.

8. The heel of claim 1 wherein the sliding characteristic i5 friction.

9. A method of changing a sliding characteristic of a shoe, the method comprising:

removing a heel member from an outsole of the shoe, the member having a fastening layer for removable attachment to an outsole in a first position having a first sliding characteristic provided in an outer layer;

changing the member from a first orientation to a second orientation;

reattaching the member to the outsole in a second position having a second sliding characteristic;

providing the outer layer with a plurality of wedges defining a series of apexes separated by a series of nadirs; and providing a different material to form the apexes and the nadirs.

10. The method of claim 9 wherein the first orientation comprises a configuration of the first position and the second orientation comprises a configuration of the second position.

11. The method of claim 10, further comprising providing a first rounded end and a second rounded end in the member, both ends corresponding to a shape of a heel section of the outsole.

12. The method of claim 9 wherein the first position provides less stopping ability than the second position.

13. The method of claim 12 wherein the plurality of wedges comprises a first angled configuration sloping toward a rear section of the heel in the first position and a second dangled configuration sloping toward a foot section of the heel in the second position.

14. The method of claim 13 further comprising rotating the first position 180 degrees from the second position relative to the outsole.

15. The method of claim 9 further comprising providing the fastening layer with interlocking hook and pile fastener materials for attaching the fastening layer to the outsole.

16. The method of claim 9 wherein the outer layer comprises molded rubber material.

17. The method of claim 9 wherein the sliding characteristic comprises friction.

* * * * *